United States Patent [19]

Skinner

[11] Patent Number: 4,672,592

[45] Date of Patent: Jun. 9, 1987

[54] SHADED TRANSDUCER

[75] Inventor: Dale D. Skinner, Severna Park, Md.

[73] Assignee: Westinghouse Electric Corp., Pittsburgh, Pa.

[21] Appl. No.: 812,048

[22] Filed: Dec. 23, 1985

[51] Int. Cl.[4] ..... H04R 17/00

[52] U.S. Cl. ..... 367/159; 367/905; 310/337; 310/369

[58] Field of Search ..... 367/157, 159, 169, 22, 367/164, 905; 310/366, 337, 369

[56] References Cited

U.S. PATENT DOCUMENTS

| | | | |
|---|---|---|---|
| 3,355,603 | 11/1967 | Hesse et al. | 310/366 |
| 4,525,645 | 6/1985 | Shirley et al. | 367/159 |
| 4,538,251 | 8/1985 | Steetle | 367/154 |

*Primary Examiner*—Charles T. Jordan
*Assistant Examiner*—John W. Eldred
*Attorney, Agent, or Firm*—D. Schron

[57] ABSTRACT

A cylindrical transducer for use as a low frequency hydrophone and having inner and outer electrodes at least one of which is deposited in a certain predetermined pattern having smooth continuous lines whereby the electrode coverage varies as a function of transducer axial length.

4 Claims, 9 Drawing Figures

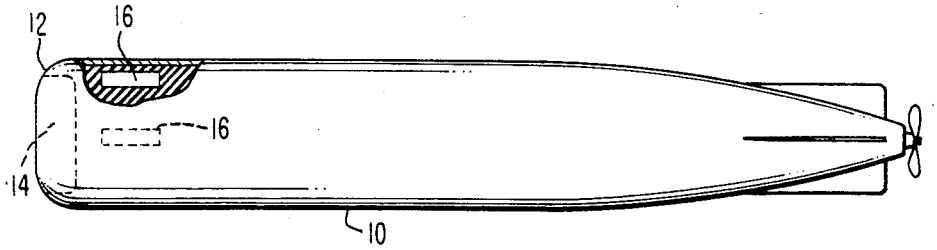
FIG. 1
FIG. 2
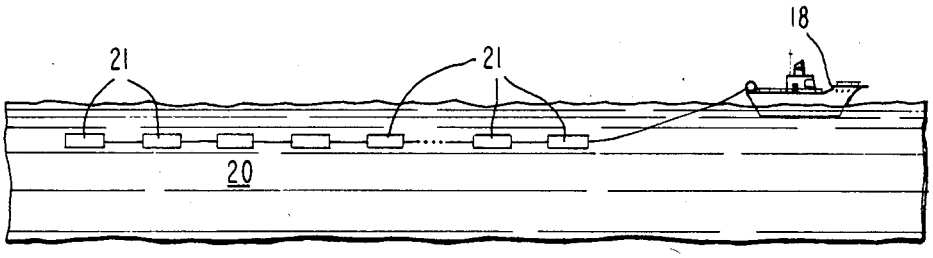
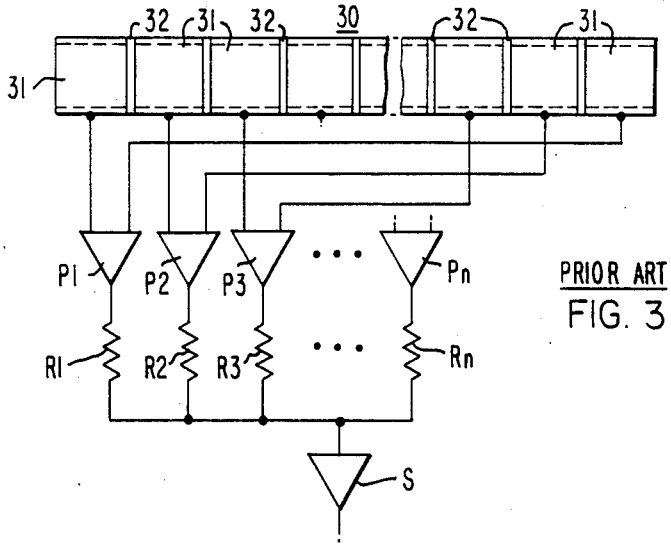
PRIOR ART
FIG. 3

SHADED TRANSDUCER

The Government has rights in this invention pursuant to contract General Order No. 42636.

BACKGROUND OF THE INVENTION

1. Field of the Invention

The invention in general relates to underwater transducers, and particularly to a hydrophone which is shaded to improve its performance.

2. Description of the Prior Art

A hydrophone is a transducer having a certain beam pattern used in the underwater environment alone, or with other transducers of an array, to detect targets. In order to improve the beam pattern, use is made of amplitude shading. Thus, by applying different weighting functions to the segments of a transducer or to the transducers of an array, the side lobe level of the beam pattern may be controlled.

Amplitude shading is also used in conjunction with a hydrophone or a hydrophone array mounted on a carrier for movement through the water by using the array aperture to discriminate against flow noise by a well-known technique known as wave vector filtering. The hydrophone transducer is made up of a plurality of transducer sections having small gaps between sections, the output of each section being weighted in accordance with any well-known shading function, and then combined to provide a hydrophone output signal. This technique requires a multitude of preamplifiers and the breaks or gaps between transducer segments can result in spurious or aliasing frequencies indicating a target where in actuality no target exists.

In the case of a stationary hydrophone, grating lobes in the beam pattern may be introduced, causing certain higher than desired side lobe levels.

The transducer of the present invention obviates the objectionable consequences of the prior art type of shading.

SUMMARY OF THE INVENTION

The apparatus of the present invention includes a thin-walled, cylindrical member of transducer material which lies along a central axis. First and second electrodes are respectively deposited on the inner and outer wall surfaces of the thin-walled cylindrical member with at least one of the electrodes being deposited to cover less than the entire wall surface on which it is deposited. This one electrode is deposited in a particular pattern, the edges of which are smooth continuous curves, with the particular curvature depending upon the particular shading function desired.

BRIEF DESCRIPTION OF THE DRAWINGS

FIGS. 1 and 2 depict carriers upon which the present invention may be utilized, FIG. 1 illustrating a torpedo, and FIG. 2 a towed line array;

FIG. 3 illustrates a cylindrical transducer and the prior art method of shading it;

DESCRIPTION OF THE PREFERRED EMBODIMENT

Figure 4:
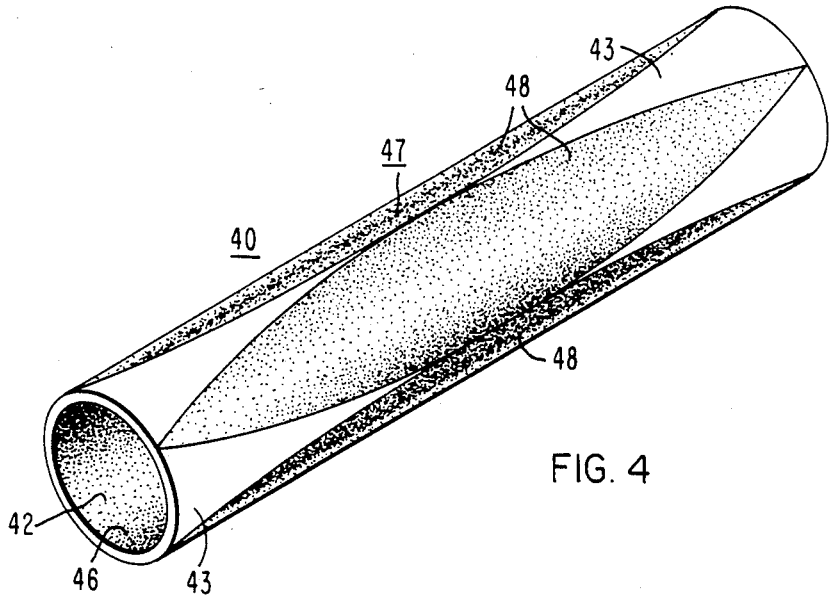
FIG. 4 is a view of one embodiment of the present invention.

FIG. 1 illustrates an underwater acoustic homing torpedo 10 having a forward nose portion 12 behind which is located a transducer array 14. In order to detect targets at greater ranges, it has been proposed to include in the torpedo a low frequency hydrophone, and to achieve some degree of directivity, a plurality of such hydrophones are utilized.

As the torpedo moves through the water, acoustic noise is generated by the water passing over the torpedo surface such that small point type hydrophones, if used, would have an extremely low signal-to-noise ratio. Accordingly, elongated transducers are preferred. Two of these transducers, indicated by the numeral 16, are illustrated in FIG. 1 with each being oriented such that its longitudinal axis is parallel to that of the torpedo. With an appropriate shading function applied to each transducer, wave vector filtering is accomplished to substantially reduce the unwanted noise component of the output signal.

Another similar situation is depicted in FIG. 2 wherein a vessel 18 is pulling a towed array 20 having a plurality of individual cylindrical transducers 21. In order to reduce the flow noise signal as the array is towed through the water, each individual transducer may be like that described with respect to transducer 16 of FIG. 1.

A typical prior art transducer arrangement for accomplishing the necessary shading is illustrated in FIG. 3 wherein by way of example a cylindrical transducer 30 is made up of a plurality of individual cylindrical segments 31 separated from its neighbor by a thin layer of compliant material 32, rubber being one example.

In response to the impingement of an acoustic signal, each of the individual elements will provide a respective output signal. Assuming a symmetrical shading function about a central element, the output signals from the first and last elements are provided to a first preamplifier P1, the outputs from the second and next to last element are provided to a second preamplifier P2, the output from the third and third from last elements are provided to preamplifier P3, etc. The output of each preamplifier is modified by a respective resistor R1 to Rn, the values of which are selected in accordance with the desired weighting function. A summing amplifier S then combines all of the individual weighted signals to provide a unitary transducer signal.

Due to the requirement of utilizing individual segments with small gaps between adjacent segments, there are small discontinuities in the shading function tending to cause objectionable grating lobes or aliasing frequencies. This objectionable operation is eliminated with the present invention, one embodiment of which is illustrated in FIG. 4 to which reference is now made.

Transducer 40 of FIG. 4 is a thin-walled cylinder made up of a transducer material which is poled in the radial direction. The electrodes for the transducer are deposited on the inner and outer wall surfaces 42 and 43, with at least one of the electrodes being deposited on less than the entire wall surface. By way of example, electrode 46 may be deposited over the entire inner wall surface 42 while electrode 47 is deposited in a predetermined pattern on the outer wall surface 43.

The particular electrode 47, by way of example, is comprised of a plurality of electrically connected sections 48, each extending parallel to the central axis of the cylinder and each being somewhat oval tending to a point at opposite ends. It is seen therefore that the middle of the cylinder has maximum electrode coverage while the ends have minimum electrode coverage, whereby the sensitivity of the transducer to acoustic signals will be less at the ends than at the center.

Figure 5:
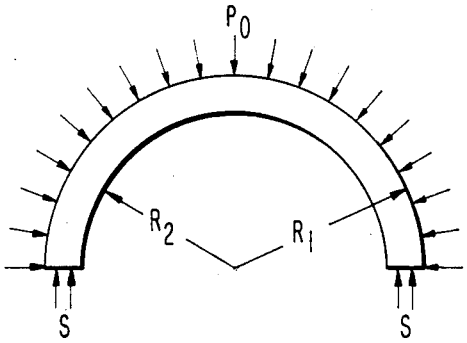
FIG. 5 is a cross-sectional view of a portion of the transducer of FIG. 4 illustrating certain dimensions and and external pressures and internal stresses.

The sensitivity of a cylindrical transducer is proportional to the stress induced in the transducer material as a result of external acoustic pressure. This may be demonstrated with reference to FIG. 5 which illustrates the end view of a half of a cylinder in the presence of an acoustic pressure signal $P_0$. $R_1$ and $R_2$ are the outer and inner radii of the cylinder while S represents the internal stress. For an increment of cylinder of unit length, these factors are related by:

$$2(R_1)(P_0)=2(R_1-R_2)S \quad (1)$$

Since the diameter $d=2R_1$ and the wall thickness $t=R_1-R_2$ then:

$$S=Pod/2t \quad (2)$$

The resultant voltage generated in response to the acoustic signal Po is related to the stress by the piezoelectric constant $g_{31}$, where $g_{31}$ is the electric field generated in the direction of polarization developed as a result of a stress applied in an orthogonal direction. The electric field $E=g_{31}(S)$ and the voltage generated is the product of electric field and the distance between electrodes. That is:

$$\text{Voltage}=V=Et=g_{31}(S)t$$

substituting from Equation (2):

$$V=(g_{31}Pod)/2 \quad (3)$$

The free field voltage sensitivity M of the hydrophone is the ratio of voltage produced per applied pressure such that:

$$M=V/Po=g_{31}d/2 \quad (4)$$

Figure 6:
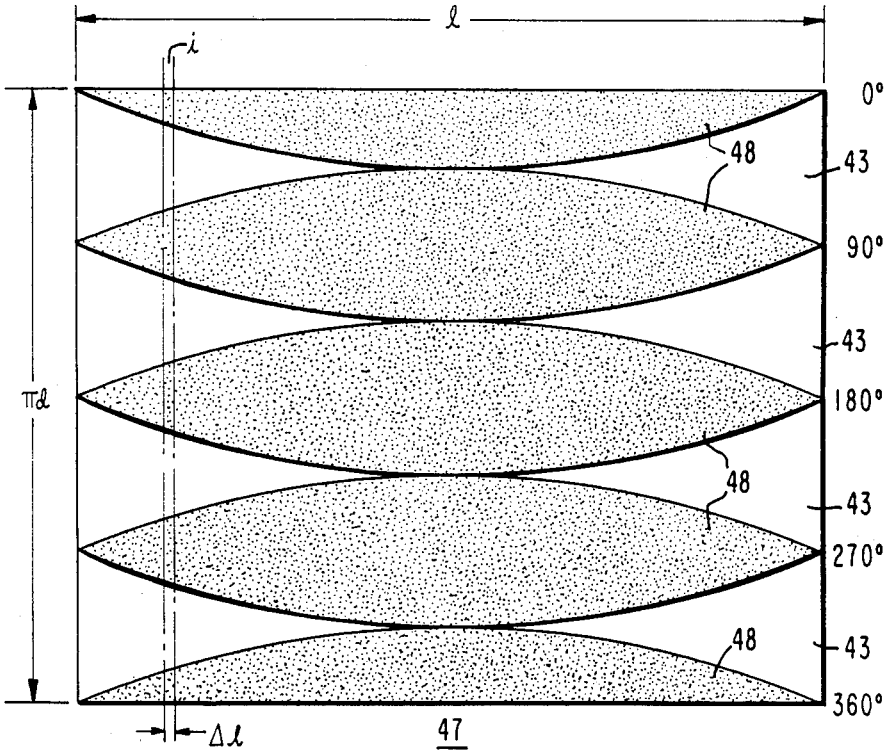
FIG. 6 illustrates the surface of the transducer of FIG. 4 unrolled onto a plane.

Any small longitudinal increment, or segment, of the cylinder develops the same voltage and sensitivity. In the transducer of the present invention, the need for a plurality of preamplifiers is eliminated and the inner and outer electrodes may be electrically connected to a single preamplifier. The voltage contribution of each elemental longitudinal segment of transducer will be a function of that segment's distance from the end of the transducer. To further illustrate this, the pattern of electrode 47 is unrolled onto a flat plane as illustrated in FIG. 6. The longitudinal length of each almond shaped electrode 48 is the same as the length of the cylinder, 1. The other dimension, $\pi d$ is equivalent to the circumference of the outer wall surface. Any small segment i has an axial dimension of $\Delta 1$ and a circumferential dimension of $\pi d$. The amount of wall surface 43 covered by the electrode 47 within segment i is defined by a coverage factor b.

The capacitance between the inner and outer electrodes of segment i (the electrode on the inner wall surface cannot be seen in FIG. 6) is:

$$C_i=(kA_ib_i)/t \quad (5)$$

where k=dielectric constant of the transducer material $A_i$=area of the increment=$(\Delta 1)(\pi d)$ $b_i$=fraction of $A_i$ covered by the electrode t=wall thickness of the cylinder In Equation 5, k, $A_i$ and t remain the same for any increment i and, accordingly, the capacitance is proportional to $b_i$ which is a function of the distance from the end of the transducer. The total capacity $C_T$ of the cylinder is the summation of the capacitances of all the increments, that is:

$$C_T=\sum_{i=1}^{n} C_i \quad (6)$$

and if $\Delta 1$ is very small compared to 1, then $C_i$ is very small compared to $C_T$.

As is the case with many hydrophones, the transducer of the present invention is operated at well below its normal resonant frequency such that the electrical impedance of the hydrophone will be very nearly equal to its capacitive reactance. Similarly, the impedance $Z_i$ of any increment i of the hydrophone will be very nearly equal to the capacitive reactance $X_{Ci}$ of that increment. That is:

$$Z_i=X_{ci}=\frac{1}{2\pi fC_i} \quad (7)$$

Substituting for $C_i$ from Equation (5):

$$Z_i=\frac{t}{2\pi fkA_ib_i} \quad (8)$$

All of the terms on the right-hand side of Equation 8, except for $b_i$, are fixed such that $Z_i$ is inversely proportional to $b_i$, that is:

$$Z_i=K(1/b_i) \quad (9)$$

Figure 7A:
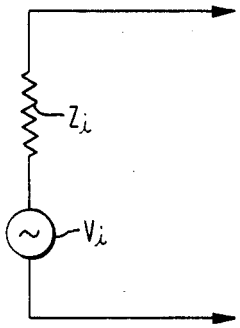
FIGS. 7A to 7C are electrical circuit equivalents to demonstrate the operation of the present invention.

Each segment i will have an equivalent electrical circuit as illustrated in FIG. 7A wherein the voltage source $V_i=(M_i)(P_0)$ from Equation 4 and the equivalent series impedance $Z_i=K(1/b_1)$ from Equation (9).

Figure 7C:
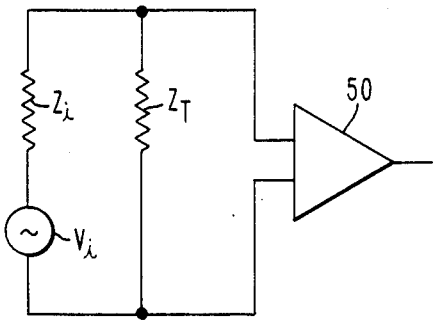
Figure 7B:
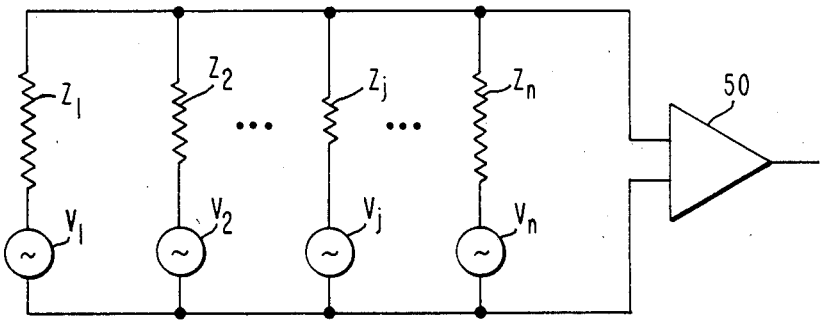

If $i=1\rightarrow n$, the entire hydrophone can be depicted by n such circuits of FIG. 7A connected in parallel electrically by the common electrodes as illustrated in FIG. 7B wherein numeral 50 represents the single, and only preamplifier needed in the practice of the present invention. Since the sensitivity $M_i$ is independent of length along the hydrophone, the voltages $V_i$ to $V_n$ will all be identical. The equivalent series impedance, however, will vary as the electrode coverage such that in the example illustrated, a middle segment j having maximum electrode coverage will have a minimum impedance $Z_j$ with the impedance, for a symmetrical arrangement, progressively increasing up until the last segments 1 and n, which will have a maximum impedance.

In view of the different impedances associated with each increment, the voltage at the preamplifier input due to any increment is a function of the impedance of that increment as well as the impedance of all the remaining increments which can be approximated by impedance $Z_T$ electrically in parallel with the preamplifier input, as illustrated in FIG. 7C.

The increment impedance $Z_i$ and the total impedance $Z_T$ act as a voltage divider. $E_i$ at the preamplifier input due to the increment is:

$$E_i = \frac{V_i Z_T}{Z_i + Z_T} \tag{10}$$

Since $Z_i$ is so much greater than $Z_T$, $Z_T$ contributes an insignificant portion of the denominator of Equation 10 such that to a good approximation:

$$E_i = \frac{V_i Z_T}{Z_i} \tag{11}$$

Further, since $V_i$ is the same for all increments and $Z_T$ is a constant, the voltage contribution $E_i$ of each segment i is inversely proportional to the segments impedance $Z_i$ and directly proportional to the coverage fraction $b_i$. That is:

$$E_i \sim 1/Z_i \sim b_i \tag{12}$$

Thus, the transducer may be selectively shaded by adjusting the electrode coverage fraction and to avoid grating lobes and aliasing frequencies the edges of the electrode sections should traverse the segments in a smooth continuous curved line, as opposed to a staircase waveform going from elemental segment to elemental segment.

Accordingly, a transducer has been described wherein shading can be accomplished on a cylindrical hydrophone by a simple variation of the electrode coverage with no incremental steps in the shading function. The shading function can be changed merely by changing the electrode pattern and only one pair of electrical leads and one preamplifier are required. In those situations where the required size of a cylindrical transducer prohibits its fabrication from a single piece of cylindrical material, a small number of such materials tightly joined end-to-end, such as by epoxy, may be utilized.

I claim:

1. A shaded transducer for providing an output signal in response to impingement of acoustic energy comprising:

(A) a thin-walled cylindrical member of transducer material and having a central longitudinal axis;

(B) first and second electrodes respectively deposited on the inner and outer wall surfaces of said thin-walled cylindrical member;

(C) at least one of said electrodes covering less than the entire wall surface on which it is deposited;

(D) said one electrode being deposited in a particular pattern, the edges of which are smooth continuous lines;

(E) said pattern being defined by a plurality of identical longitudinal sections symmetrically disposed about said longitudinal axis;

(F) each said section touches a neighboring section midway between the ends of said thin-walled cylindrical member;

(G) a preamplifier having first and second inputs;

(H) said first and second electrodes being electrically connected to said first and second inputs.

2. Apparatus according to claim 1 wherein:

(A) said lines are curved lines.

3. Apparatus according to claim 1 wherein:

(A) said electrode on said inner wall surface covers the entire surface thereof.

4. Apparatus according to claim 1 wherein:

(A) said sections taper from a maximum circumferential dimension at the middle of said thin-walled cylindrical member to a minimum at its ends.

* * * * *